US007058495B2

(12) United States Patent
Budde et al.

(10) Patent No.: US 7,058,495 B2
(45) **Date of Patent: *Jun. 6, 2006**

(54) WORK IMPLEMENT CONTROL SYSTEM AND METHOD

(75) Inventors: Steven Conrad Budde, Peoria, IL (US); Satish L. Kale, Lemont, IL (US)

(73) Assignee: Caterpillar Inc., Peoria, IL (US)

( * ) Notice: Subject to any disclaimer, the term of this patent is extended or adjusted under 35 U.S.C. 154(b) by 318 days.

This patent is subject to a terminal disclaimer.

(21) Appl. No.: 10/654,425

(22) Filed: Sep. 4, 2003

(65) Prior Publication Data

US 2005/0065689 A1 Mar. 24, 2005

(51) Int. Cl.
*G06F 7/70* (2006.01)

(52) U.S. Cl. ..... 701/50; 701/36; 37/234; 172/819

(58) Field of Classification Search ..... 701/1, 701/36, 50; 700/83, 282, 275; 37/234, 235, 37/236; 172/810, 811, 819
See application file for complete search history.

(56) References Cited

U.S. PATENT DOCUMENTS

| | | | |
|---|---|---|---|
| 4,630,685 | A | 12/1986 | Huck, Jr. et al. |
| 5,462,125 | A | 10/1995 | Stratton et al. |
| 5,897,600 | A | 4/1999 | Elmore et al. |
| 5,911,769 | A | 6/1999 | Orbach et al. |
| 5,918,682 | A | 7/1999 | Fan et al. |
| 6,091,997 | A | 7/2000 | Flamme et al. |
| 6,199,000 | B1 | 3/2001 | Keller et al. |
| 6,230,091 | B1 | 5/2001 | McQuinn |
| 6,282,453 | B1 | 8/2001 | Lombardi |
| 6,363,632 | B1 | 4/2002 | Stentz et al. |
| 6,718,246 | B1 | 4/2004 | Griffith et al. |
| 2001/0018638 | A1 | 8/2001 | Quincke |

*Primary Examiner*—Richard M. Camby
(74) *Attorney, Agent, or Firm*—Finnegan, Henderson, Farabow, Garrett & Dunner LLP

(57) ABSTRACT

A system and method for controlling a work implement of a work machine are provided. A preset position for the work implement is established. An implement positioning system is enabled. An indication of a change in a travel direction of the work machine is received. The work implement is moved to the preset position in response to the indication of the change in the travel direction when the implement positioning system is enabled.

33 Claims, 4 Drawing Sheets

WORK IMPLEMENT CONTROL SYSTEM AND METHOD

TECHNICAL FIELD

The present invention is directed to a system and method for controlling a work implement and, more particularly, to a system and method for controlling the position of a work implement on a work machine.

BACKGROUND

A work machine is typically equipped with a work implement that is adapted to perform a certain task. For example, the work implement may be adapted to move a load of earth or other material from one location to another location. A work machine such as a wheeled or tracked dozer may be equipped with a blade, whereas a work machine such as an excavator may be equipped with a bucket or shovel.

The work machine may include an input device having a series of input mechanisms that allow an operator to control the motion of the work machine and the motion of the work implement relative to the work machine. The input mechanisms may include, for example, a combination of joysticks, buttons, and/or levers. By manipulating the input mechanisms, the operator may control the motion of the work machine and the work implement to perform a work task.

A dozing machine, such as a wheeled or tracked dozer, may be used to perform a material moving, spreading, or compacting work task. The successful completion of this type of task may require that the operator make several passes with the dozing machine. Accordingly, this type of task may be referred to as a "repeat pass" type of work task.

When performing a "repeat pass" type of work task, the operator of a dozing machine may repeatedly move the work implement between a lowered, or working position and an elevated position, depending upon the direction of travel of the work machine. For example, during a compacting operation, the operator may move the work implement to the lowered position when the work machine is moving in a forward direction so that the blade is in position to engage the material to be compacted. The operator may raise the work implement when the particular pass is completed and the travel direction of the work machine is changed to a reverse direction. By raising the work implement, the operator may prevent an undesired spreading of the material to be compacted as the work machine moves in the reverse direction.

The repetitive nature of the actions required to complete a repeat pass type of work task typically requires the operator to manipulate several different input mechanisms in a repetitive manner. The operator will require a certain amount of time to perform the repetitive manipulations necessary to raise and lower the work implement on each pass of a repeat pass work task. The accumulation of this manipulation time may result in a decrease in the overall productivity of the work machine during the performance of the repeat pass work task.

A work machine may include an automated work implement positioning system. For example, as described in U.S. Pat. No. 5,462,125 to Stratton et al., a work machine may include an electronic control adapted to automatically move a blade of a dozing machine to one of several pre-set angle positions. When the operator selects one of the pre-set angle positions, the electronic control will adjust the tilt of the work implement to move the blade to the desired angle position.

However, the control system described in the '125 patent may not reduce the amount of work required by an operator to perform a repeat pass type of work task. The control system described in the '125 patent governs only the angle of the work implement. The operator would still have to manipulate the appropriate input mechanisms to raise and lower the work implement each time the direction of the work machine is changed. Accordingly, the operator would still be required to perform repetitive manipulations of the input mechanisms to raise and lower the work implement and complete the repeat pass work task.

The present disclosure is directed to overcoming one or more of the problems identified above.

SUMMARY OF THE INVENTION

According to one aspect, the present disclosure is directed to a method for controlling a work implement of a work machine. A preset position for the work implement is established. An implement positioning system is enabled. An indication of a change in a travel direction of the work machine is received. The work implement is moved to the preset position in response to the indication of the change in the travel direction when the implement positioning system is enabled.

In another aspect, the present disclosure is directed to a control system for a work implement on a work machine. A sensor provides an indication of a change in a travel direction of the work machine. An input device is adapted to selectively enable an implement positioning system. A controller that has a memory adapted to store a preset position for the work implement is operable to move the work implement to the preset position in response to an enabling manipulation of the input device and the indication of the change in the travel direction of the work machine.

DETAILED DESCRIPTION

Figure 1A:
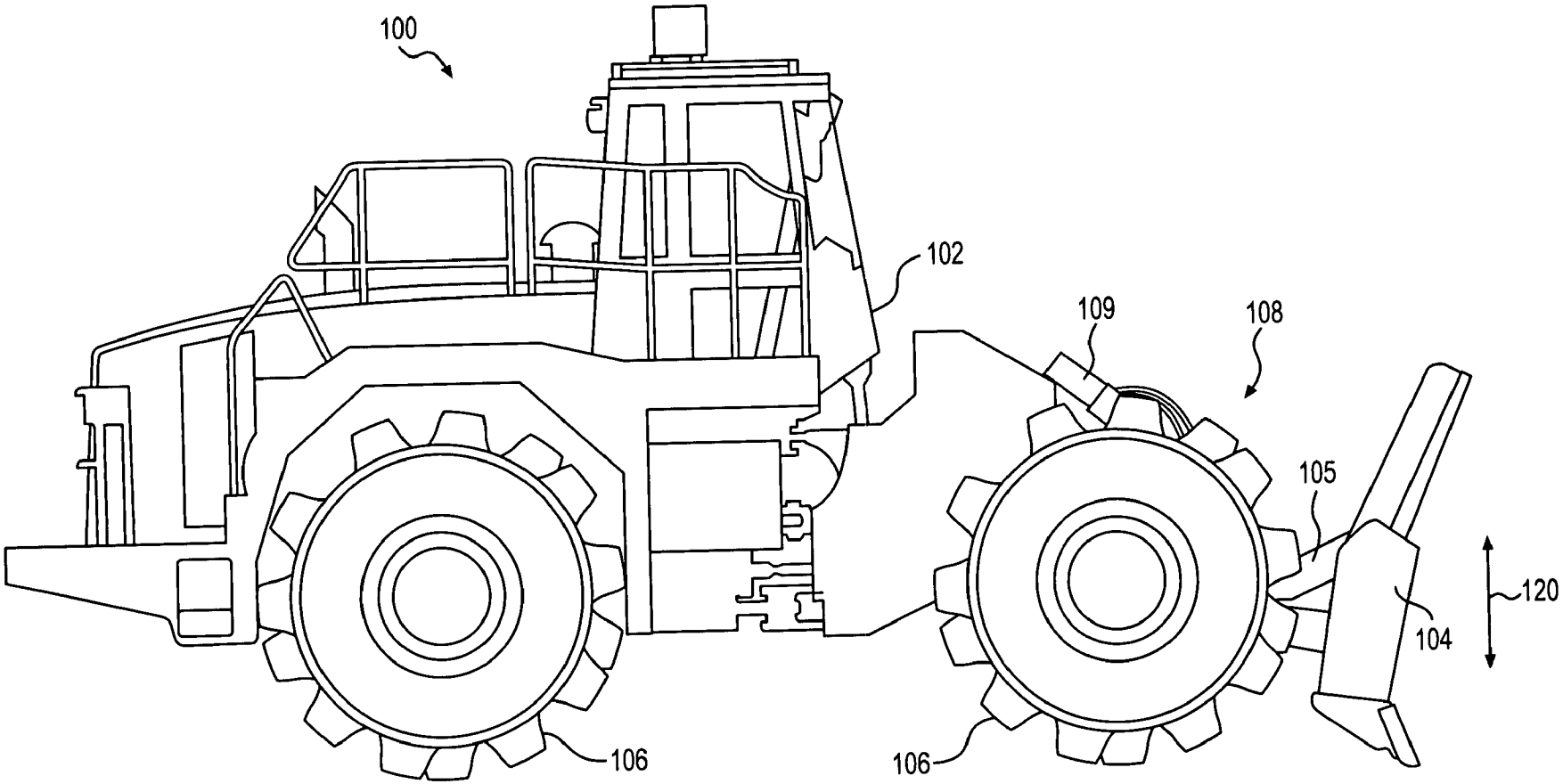
FIG. 1*a* is a side pictorial view of a exemplary work machine having a work implement.
Figure 1B:
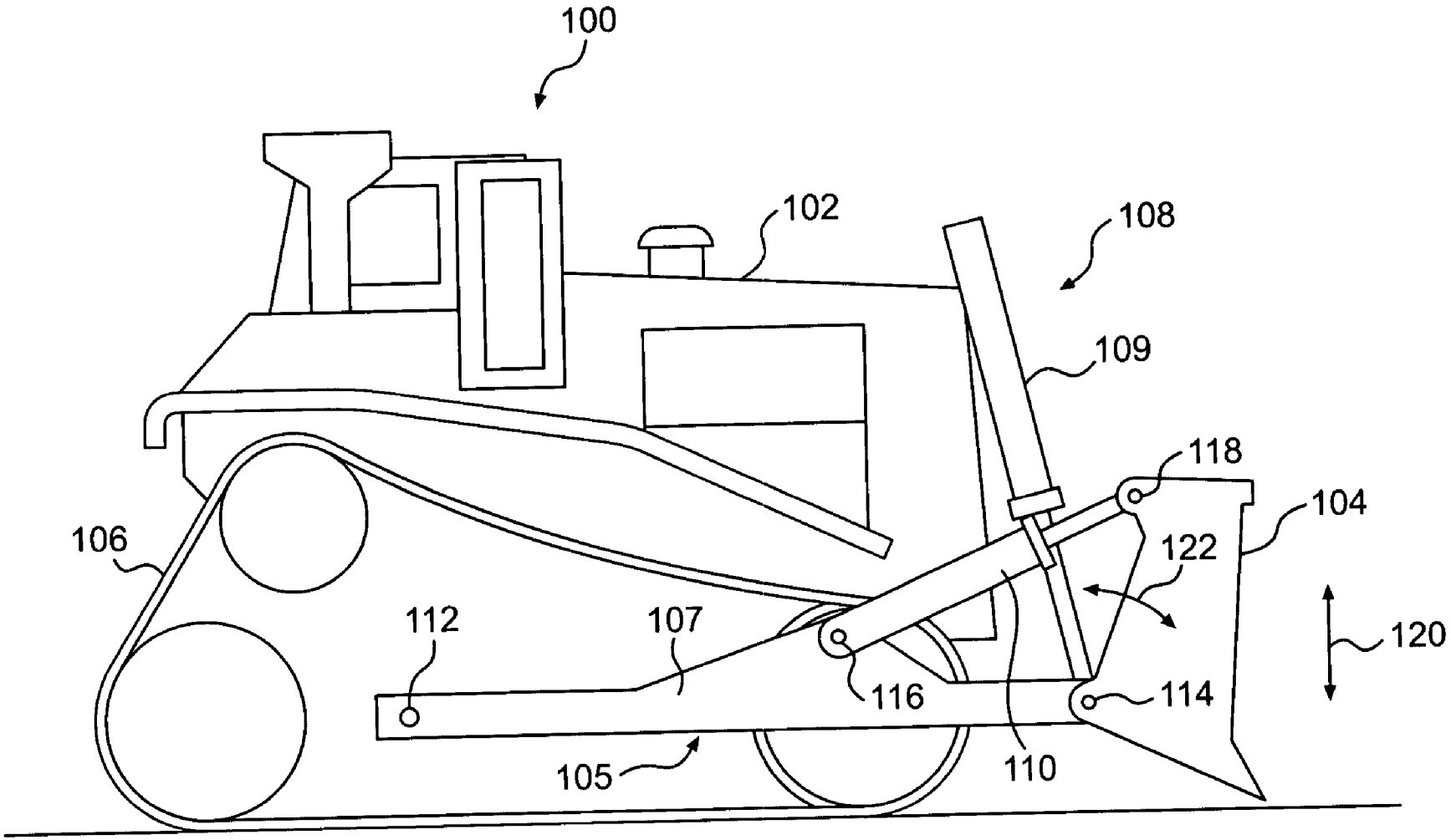
FIG. 1*b* is a side pictorial view of another exemplary work machine having a work implement.

Exemplary embodiments of a work machine 100 are illustrated in FIGS. 1*a* and 1*b*. Work machine 100 may include a housing 102 mounted on a traction device 106. In the embodiment illustrated in FIG. 1*a*, traction device 106 includes a set of wheels adapted to compact material. Alternatively, as shown in FIG. 1*b*, traction device 106 may include a pair of tracks (only one of which is illustrated). It should be noted that traction device 106 may be any other type of traction device commonly used with a work machine.

Figure 2:
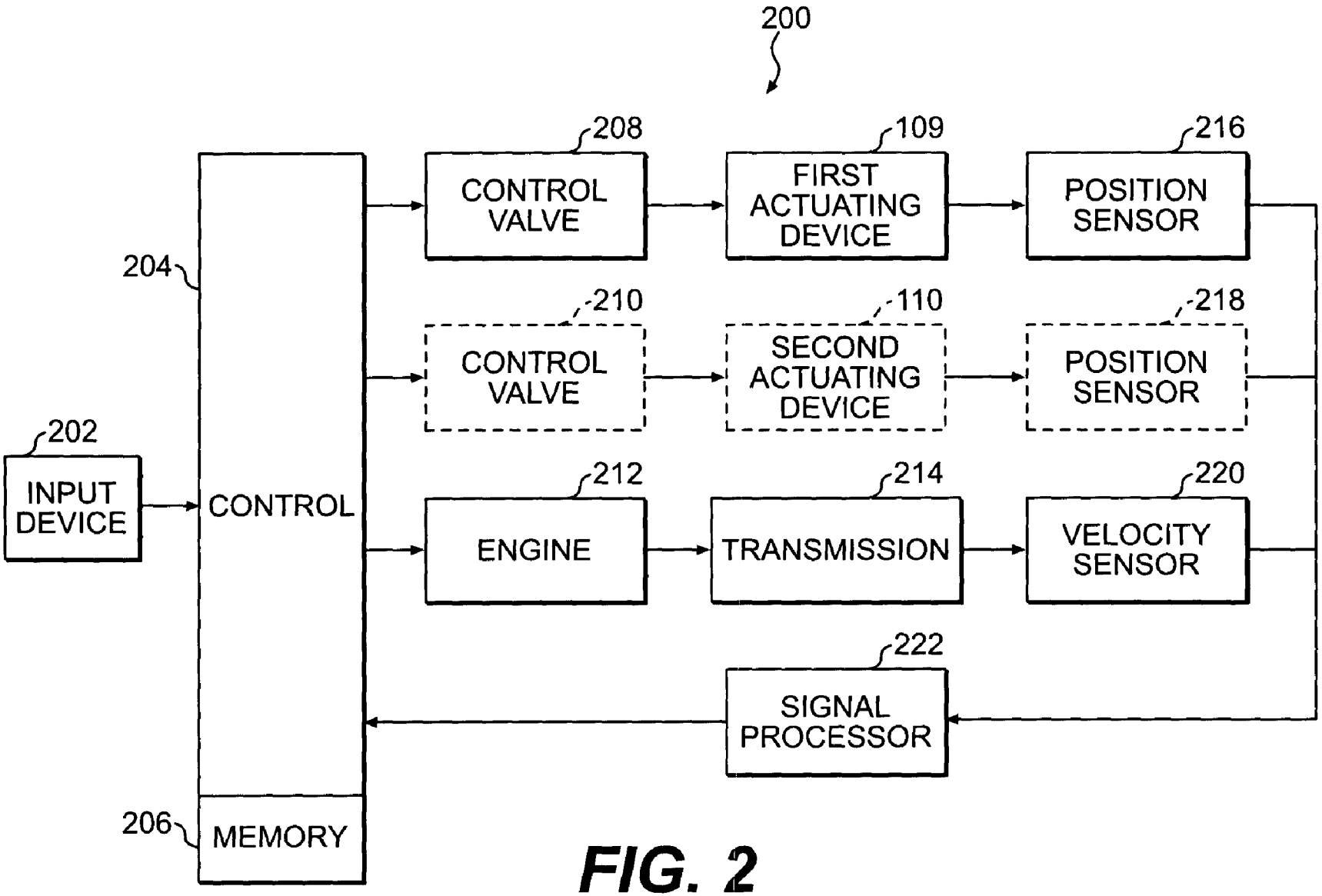
FIG. 2 is a schematic and diagrammatic representation of an exemplary control system for a work machine in accordance with the present invention.

Work machine 100 may include an engine 212 (referring to FIG. 2) such as an internal combustion engine and a transmission 214 (referring to FIG. 2) such as a continuously variable transmission. Transmission 214 may connect engine 212 to traction device 106 and may be, for example, a gear-driven transmission or a hydrostatic transmission.

Transmission 214 may be moved from a neutral position to an engaged position where power generated by engine 212 is transmitted to traction device 106 to thereby propel work machine 100. Transmission 214 may be engaged in a forward gear, where traction device 106 and work machine 100 are moved in a forward direction, or in a reverse gear, where traction device 106 and work machine 100 are moved in a reverse direction. One skilled in the art will recognize that the operation of engine 212 and transmission 214 may be controlled to vary the speed and travel direction of work machine 100.

It is contemplated, however, that work machine 100 may include another type of drive mechanism adapted to drive traction device 106. For example, work machine 100 may include an electric drive adapted to drive traction device 106. Alternatively, work machine 100 may include a hybrid drive or any other device adapted to drive traction device 106.

Work machine 100 may also include a work implement 104 that is adapted to perform a particular work task. In the illustrated embodiments, work implement 104 is a blade that may be used, for example, in a material spreading or moving work task. It is contemplated, however, that work implement may be any type of work implement commonly used with a work machine, such as, for example, a bucket or a shovel.

A linkage assembly 105 connects work implement 104 to housing 102. Linkage assembly 105 may be adapted to provide the work implement 104 with the degrees of freedom necessary to complete the particular work task. In the embodiment of FIG. 1*a*, linkage assembly 105 provides a single degree of freedom for work implement 104. In the embodiment of FIG. 1*b*, linkage assembly 105 provides two degrees of freedom for work implement 104. It is contemplated, however, that linkage assembly 105 may be adapted to provide a greater, or lesser, number of degrees of freedom for a different type of work implement 104.

As shown in FIG. 1*b*, linkage assembly 105 may include one or more support arms 107 (only one of which is illustrated in FIG. 1*b*). One end of support arm 107 is connected to housing 102 at a joint 112. The other end of support arm 107 is connected to work implement 104 at a joint 114. Joints 112 and 114 allow work implement 104 to pivot relative to support arms 107 and allow support arm 107 to pivot relative to housing 102.

Work machine 100 may also include a hydraulic system 108 that is connected with linkage assembly 105 and is adapted to move work implement 104 relative to work machine 100. Hydraulic system 108 may include a first actuating device 109 and a second actuating device 110. Each of first and second actuating devices 109, 110 may include one or more hydraulic actuators, such as, for example, hydraulic cylinders.

Each of first and second actuating device 109 and 110 may be operatively connected to support arms 107 and/or work implement 104. First actuating device 109 may be connected to support arms 107 and work implement 104 at joint 114. Second actuating device 109 may be connected with support arms 107 at a joint 116 and with work implement 104 at a joint 118.

Hydraulic system 108 may include a source of pressurized fluid (not shown) such as, for example, a variable displacement pump, that is in fluid connection with first and second actuating devices 109 and 110. The source of pressurized fluid may be connected to the engine of work machine 100. The engine may power the source of pressurized fluid to generate a flow of pressurized fluid that may be used to power each of first and second actuating devices 109 and 110.

The flow of pressurized fluid may be used to actuate first actuating device 109 to move work implement 104 in the direction indicated by arrow 120. By controlling the rate and direction of fluid flow to and from first actuating device 109, the rate and direction at which work implement 104 is raised and lowered may be controlled. In this manner, work implement 104 may be moved between an elevated position and a lowered position.

The flow of pressurized fluid may also be used to actuate second actuating device 110 to move work implement 104 in the direction indicated by arrow 122. By controlling the rate and direction of fluid flow to and from second actuating device 110, the rate and direction at which the angle of work implement 104 is varied may be controlled. In this manner, the angle of work implement 104 relative to housing 102 may be varied.

Work machine 100 may also include a control system adapted to control the movement of work implement 104. An exemplary embodiment of a control system 200 is diagrammatically and schematically illustrated in FIG. 2. An input device 202 may be adapted to provide an input signal to a control 204. Input device 202 may be any type of input device commonly used with a work machine and may include a series of input mechanisms. The series of input mechanisms may include, for example, one or more joysticks, levers, switches, and/or buttons that are adapted to allow an operator to control the motion of work machine 100 and work implement 104. For example, input device 202 may include one or more of a lift control lever, an implement positioning system switch, a position setting switch, an implement lockout switch, a work machine direction control, a parking brake, an engine throttle control, and a neutralizer pedal.

Control 204 may include a computer, which has all the components required to run an application, such as, for example, a memory 206, a secondary storage device, and a processor, such as a central processing unit. One skilled in the art will appreciate that this computer can contain additional or different components. Furthermore, although aspects of the present invention are described as being stored in memory, one skilled in the art will appreciate that these aspects can also be stored on or read from other types of computer program products or computer-readable media, such as computer chips and secondary storage devices, including hard disks, floppy disks, CD-ROM, or other forms of RAM or ROM.

Control 204 may be operatively connected to a series of control valves 208 and 210. Control valve 208 may be disposed in a fluid line leading to first actuating device 109. Control valve 210 may be disposed in a fluid line leading to second actuating device 110.

Each control valve 208 and 210 may be adapted to control the rate and direction of fluid flow to the respective actuating device. For example, control valve 208 controls the rate and direction of the fluid flow to first actuating device 109 and control valve 210 controls the rate and direction of the fluid flow to second actuating device 110. Each control valve 208 and 210 may be a direction control valve, such as, for example a single spool valve, a set of independent metering valves, or any other mechanism configured to control the rate and direction of a fluid flow into and out of the respective actuating device.

Control 204 is configured to control the relative positions of control valves 208 and 210 to thereby control the rate and direction of fluid flow therethrough. By controlling the rate and direction of fluid flow through control valves 208 and 210, control 204 may control the rate and direction of movement of first and second actuating devices 208 and 210. In this manner, the rate and direction of movement of work implement 104 may be controlled.

Control system 200 may include a series of sensors that are adapted to provide information related to the operation of work machine 100. For example, position sensors 216 and 218 may be adapted to provide information related to the position of first and second actuating devices 109 and 110. Based on the information provided by position sensors 216 and 218, control 204 may determine the location of work implement 104 relative to housing 102.

It is contemplated that additional sensors may be operatively engaged with work machine 100 to provide additional information related to the operation of work machine 100. For example, a velocity sensor 220 may be operatively engaged with transmission 214, or another portion of the drive train of work machine 100, to provide an indication of the current ground speed of work machine 100. Additional sensors may be adapted to provide information related to the operating speed of engine 212, the operation of transmission 214, the status of the parking brake, the travel direction of work machine 100, and any other relevant operating parameter of work machine 100.

A signal processor 222 may be included to condition the signals from the sensors. Signal processor 222 may be adapted to convert the received signals to appropriate communications for control 204, such as, for example, an analog to digital conversion. It is contemplated that signal processor 222 may be integrated with control 204 or be a separate component.

Control 204 may include a set of operating instructions that may be used to control the position of work implement 104 based on the monitored operating conditions of work machine 100. This set of operating instructions may be referred to in this disclosure as an "implement positioning system." Control 204 may use the instructions of the implement positioning system to automatically move work implement 104 to a preset elevated position or a preset lowered position based on certain operating conditions of work machine 100. The flowchart of FIG. 3 illustrates an exemplary method 300 of automatically moving work implement 104 to one of the preset elevated and lowered positions.

INDUSTRIAL APPLICABILITY

The implement positioning system described herein may automatically control the position of work implement 104 to improve the efficiency of a dozing type work machine 100 in performing a repeat pass work task. In particular, the implement positioning system may move work implement 104 to a preset elevated position when work machine 100 has completed a work pass and is moving into position for another work pass. The implement positioning system may move work implement 104 to a preset lowered, or working, position when work machine 100 is positioned to start another work pass. It is contemplated, however, that the concepts described in the present disclosure may be applied to other types of work machines and other types of work tasks.

Figure 3:
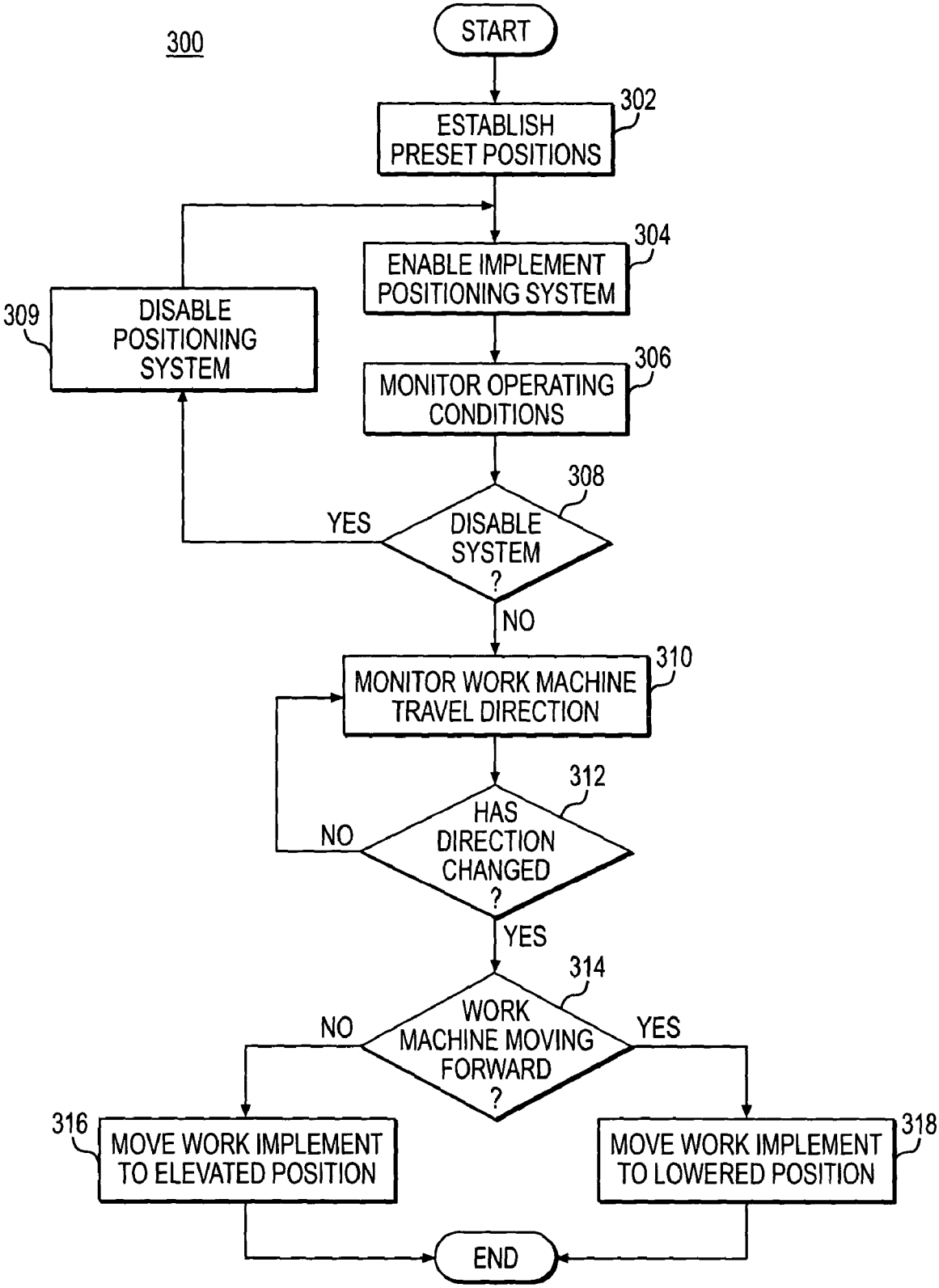
FIG. 3 is a flow chart illustrating an exemplary method of controlling a work implement in accordance with the present invention.

As shown in the method 300 of FIG. 3, the operator may establish preset positions for the work implement 104. (Step 302). The operator may establish a preset elevated position and a preset lowered position. These preset positions may be established by manipulating input device 202 to move work implement 104 to a desired elevated position and providing an indication to control 204 that work implement 104 is in the desired elevated position. The indication may be provided, for example, by manipulating an appropriate position setting switch. Upon receipt of the indication, control 204 may determine the position of work implement 104 based on information from position sensors 216 and 218. The current position of work implement 104 may be stored in memory 206 as the preset elevated position. The operator may then move the work implement 104 to the desired lowered, or working, position and provide an indication to control 204 that work implement 104 is in the desired lowered position. Control 204 may determine the current position of work implement 104 and store the current position of work implement 104 in memory 206 as the preset lowered positions.

Input device 202 may include a separate position setting switch for setting the preset elevated position and the preset lowered position. Each position setting switch may be a trigger, a button, a switch, or other like device. When work implement 104 is in the desired elevated position, operator may manipulate an elevated position setting switch to set the preset elevated position. When work implement 104 is in the desired lowered position, operator may manipulate a lowered position setting switch to set the preset lowered position. Alternatively, the implement positioning system may require that the operator establish the preset elevated and lowered positions in a certain sequence. In this manner, control 204 may distinguish between the preset elevated position and the preset lowered position.

It should be noted that memory 206 may be adapted to store additional preset positions for work implement 104. It is contemplated that an additional lowered position and an additional elevated position may be established for a work machine that may be used in two or more working modes. For example, in a compacting machine, the operator may repetitively move work implement 104 to a first lowered position during a material spreading work mode and to a second lowered position during a material compacting work mode. An additional input mechanism, such as a working mode switch, may be provided to allow the operator select the appropriate working mode for the work machine and to allow the control to identify the appropriate preset position to which work implement 104 should be moved.

It is also contemplated that a preset position for the work implement 104 may be established in another manner. For example, one or more switches or sensors may be disposed on work machine 100 to establish a preset position. The switches may be positioned such that movement of the work implement 104 to the preset position activates a switch to provide an indication that work implement 104 is at the present position. In response to the indication, control 204 may prevent work implement 104 from moving further.

When the operator so desires, the implement positioning system may be enabled. (Step 304). The implement positioning system may be enabled by providing an indication to control 204. For example, the operator may enable the implement positioning system by manipulating an implement positioning switch, which may be a trigger, a button, a switch, or other like device. Control 204 may provide an indication to the operator to indicate that the implement positioning system has been enabled. For example, control 204 may provide a visual indication, such as by illuminating an indicator light, and/or an audible indication, such as a beep or a series of beeps.

It is contemplated control 204 may require a certain indication from the implement positioning switch before enabling the implement positioning system. For example, control 204 may require that the implement positioning switch be depressed or otherwise manipulated for a certain period of time before the implement positioning system is enabled. In this manner, control 204 may prevent an accidental or unintended enabling of the implement positioning system.

Control 204 may continually monitor one or more operating conditions or parameters of work machine 100 to determine if the implement positioning system should remain enabled. (Step 306). For example, control 204 may monitor the operating state of the engine associated with work machine 100. In addition, control 204 may monitor other components of work machine 100. For example, control 204 may monitor the position of the implement positioning switch, a parking brake, and an implement lockout switch. These conditions, parameters, and components may be monitored on a periodic or continual basis.

Control 204 may disable the implement positioning system if one or more of the monitored operating conditions, parameters, and components indicate that work implement 104 should not be moved automatically. (Step 308) For example, if the engine is not operating, the implement positioning system should be disabled. In addition, control 204 may disable the implement positioning system if the parking brake is in an engaged position or is moved to an engaged position to prevent movement of work machine 100. Control 204 may also disable the implement positioning system if the implement lockout switch is in or is moved to an "on" position to prevent movement of work implement 104. Control 204 may further disable the implement positioning system if the work implement is "locked" or prevented from moving in response to a system fault or a change in work machine operating conditions. Control 204 may disable the implement positioning system if control 204 determines that work machine 100 is no longer in a working mode, such as when transmission 214 is moved to a neutral position for a predetermined period of time. If the status of one or more of the monitored operating conditions, parameters, or components change, control 204 may disable the implement positioning system.

It is contemplated that control 204 may provide a warning to the operator when the implement positioning system is disabled as a result of a change in the operating conditions of the work machine 100. This warning may be any type of indication commonly used to provide status information to an operator. For example, the warning may be a visual indication, such as a change in the color or illumination of a status light, and/or an audible indication, such as a beep or series of beeps.

If one or more of the monitored operating conditions indicate that the implement positioning system should be disabled, control 204 will override the operator's instructions to enable the implement positioning system. (Step 309). When the implement positioning system is disabled, control 204 will monitor the position of the implement positioning switch. The operator may re-enable the implement positioning system with an appropriate manipulation of the implement positioning switch.

If the implement positioning system remains enabled, control 204 will monitor the travel direction of work machine 100. (Step 310). Control 204 may monitor the travel direction of work machine 100 by monitoring the position of an input mechanism adapted to control the travel direction of work machine 100, by monitoring the operation of transmission 214, or by monitoring the rotational direction of traction devices 106. It is contemplated that the travel direction may be monitored through any other work machine component or system readily apparent to one skilled in the art.

Control 204 monitors the travel direction to determine when the travel direction of work machine changes. (Step 312). Control 204 may monitor the position and/or manipulation of the input mechanism responsible for controlling the travel direction of work machine 100 to determine when the operator requests a change in the travel direction of work machine 100. Alternatively, control 204 may monitor another component of work machine 100, such as the operation of transmission 214 or traction device 106 to determine when the travel direction of work machine 100 changes.

Control 204 may determine the new direction of travel, such as, for example, if the travel direction of work machine has changed to the forward direction. (Step 314). If the travel direction of work machine 100 has changed from a forward direction to a reverse direction such as when a work pass is completed, control 204 may move work implement 104 to the preset elevated position. (Step 316). If the travel direction of work machine 100 has changed from the reverse direction to the forward direction such as when positioning to begin a new work pass, control 204 may move work implement 104 to the preset lowered position. (Step 318).

It should be noted that the implement positioning system may move work implement to the preset position when transmission 214 is shifted from a neutral position to either the forward direction or the reverse direction. For example, the implement positioning system may move work implement 104 to the preset lowered position when transmission 214 is shifted from neutral to the forward direction. In addition, the implement positioning system may move work implement 104 to the preset elevated position when transmission 214 is shifted from neutral to the reverse direction. The implement positioning system may not reposition work implement 104 when transmission 214 is shifted from one direction to neutral and back to the same direction, i.e. transmission 214 is shifted from the forward direction to neutral and back to the forward direction.

It is contemplated that control 204 may monitor additional operating conditions to determine if work implement 104 should be moved to one of the preset positions. For example, control 204 may monitor the position of the input mechanism adapted to control the movement of work implement 104. If this input mechanism is in a centered position when the travel direction of work machine 100 changes, control 204 will move work implement to the appropriate preset position. If this input mechanism is not in the centered position, indicating that the operator desires a certain movement of work implement 104, control 204 may move work implement 104 according to the operator's instructions.

Control 204 may also monitor the ground speed of work machine 100 before moving work implement 104 to the preset position. If the ground speed of work machine 100 increases above a predetermined limit within a predetermined period of time, such as, for example, 5 seconds, the implement positioning system may move work implement 104 to the preset position. If, however, the ground speed of work machine 100 does not increase to above the predetermined limit within the predetermined period of time, the implement positioning system may not move work implement 104 to the preset position until the next change in direction is detected. The predetermined limit for the work machine ground speed may be set at a speed that is indicative of a change in travel direction at the end or at the beginning of a work pass. It should be noted that other parameters related to the ground speed of work machine 100, such as, for example, the acceleration of work machine 100, may be monitored to determine if work implement 104 should be repositioned to the preset position.

Control 204 may further control the speed at which work implement 104 is moved to the appropriate preset position. The movement speed of work implement 104 may be based on the operating conditions of work machine 100. For example, the movement speed of work implement 104 may be increased when the ground speed of the work machine 100 or the operating speed of engine 212 is relatively high. Alternatively, the movement speed of work implement 104 may be decreased when the ground speed of the work machine 100 or the operating speed of engine 212 is relatively low. It is contemplated that the movement speed of work implement 104 may be based on a combination of these or other operating conditions of work machine 100.

It is contemplated that control 204 may move work implement 104 in a predetermined direction for a predetermined period of time in response to a change in direction of work machine 100. For example, when the travel direction of work machine 100 is changed from a forward direction to a reverse direction, control 204 may move work implement towards an elevated position for a predetermined period of time. When the travel direction of work machine 100 is changed from the reverse direction to a forward direction, control 204 may move work implement towards a lowered position for a predetermined period of time.

It is further contemplated that additional controls and/or systems may be used to control the movement of work implement 104 to the appropriate preset position. For example, a system may be included to "cushion" the movement of work implement 104 to the appropriate present position. This may be accomplished, for example, by reducing the speed of the work implement 104 as the work implement 104 nears the appropriate present position.

Thus, the control system described above may be used to automatically move a work implement during a repetitive work task. The work implement may be moved to an elevated position when the work machine reaches the end of a work pass and reverses direction to reposition for another pass. In addition, the work implement may be moved to a lowered, or working, position to begin a new work pass. In this manner, the described control system may reduce the amount of work required of an operator to complete a particular work task.

It will be apparent to those skilled in the art that various and modifications and variations can be made in the described control system and method without departing from the scope of the disclosure. Other embodiments of the disclosed position control system and method will be apparent to those skilled in the art from consideration of the specification and practice of the system and method disclosed herein. It is intended that the specification and examples be consider as exemplary only, with a true scope being indicated by the following claims and their equivalents.

What is claimed is:

1. A method for controlling a work implement on a work machine, comprising:

enabling an implement positioning system;

receiving an indication of a change in a travel direction of the work machine; and moving the work implement in a predetermined direction for a predetermined period of time in response to the indication of the change in the travel direction of the work machine when the implement positioning system is enabled.

2. The method of claim 1, further including:

moving the work implement towards an elevated position for the predetermined period of time when the travel direction of the work machine is changed from a forward direction to a reverse direction; and moving the work implement towards a lowered position for the predetermined period of time when the travel direction of the work machine is changed from the reverse direction to the forward direction.

3. A method for controlling a work implement on a work machine, comprising:

establishing a preset position for the work implement;

enabling an implement positioning system;

receiving an indication of a change in a travel direction of the work machine;

receiving an indication of a monitored operating condition of the work machine, the monitored operating condition being indicative of a speed of the work machine; and moving the work implement to the preset position in response to the indication of the change in the travel direction when the implement positioning system is enabled and in response to the monitored operating condition of the work machine.

4. The method of claim 3, wherein receiving an indication of a monitored operating condition includes receiving at least one of a ground speed, a transmission speed, an engine speed, and a work machine acceleration.

5. The method of claim 3, wherein a speed at which the work implement is moved to the preset position is based on the monitored operating condition of the work machine.

6. The method of claim 3, wherein the work implement is moved to the preset position when the monitored operating condition indicates that at least one of a ground speed is above a predetermined limit and a work machine acceleration is above a predetermined limit.

7. The method of claim 3, further including establishing a preset elevated position and a preset lowered position.

8. The method of claim 7, further including:

moving the work implement to the preset elevated position when the travel direction of the work machine is changed from a forward direction to a reverse direction; and moving the work implement to the preset lowered position when the travel direction of the work machine is changed from the reverse direction to the forward direction.

9. The method of claim 3, wherein establishing a preset position includes:

establishing a first preset upper position and a first preset lower position for the work implement; and establishing a second preset upper position and a second preset lower position for the work implement.

10. A method for controlling a work implement on a work machine, comprising:

establishing a first preset upper position and a first preset lower position for the work implement;

establishing a second preset upper position and a second preset lower position for the work implement;

enabling an implement positioning system;

receiving an indication of a change in a travel direction of the work machine; and moving the work implement to one of the first preset upper position, the first preset lower position, the second preset upper position and the second preset lower position in response to the indication of the change in the travel direction when the implement positioning system is enabled.

11. The method of claim 10, including switching the work machine between a first mode and a second mode, wherein moving the work implement includes moving the work implement to the first upper or lower position when operating in the first mode and to the second upper or lower position when operating in the second mode.

12. The method of claim 10, including:

receiving an indication of a monitored operating condition of the work machine, the monitored operating condition being indicative of a speed of the work machine; and moving the work implement to the preset position in response to the monitored operating condition of the work machine.

13. The method of claim 12, wherein receiving an indication of a monitored operating condition includes receiving at least one of a ground speed, a transmission speed, an engine speed, and a work machine acceleration.

14. A method for controlling a work implement on a work machine, comprising:

establishing a preset position for the work implement;

enabling an implement positioning system;

receiving an indication of a change in a travel direction of the work machine;

receiving an indication of a position of at least one manually operated component; and moving the work implement to the preset position in response to the indication of the change in the travel direction when the implement positioning system is enabled and when the manually operated component is in a predesignated position.

15. The method of claim 14, wherein receiving an indication of a position of a manually operated component includes receiving an indication of a position of a parking brake and a position of an implement lockout switch.

16. The method of claim 15, wherein enabling the implement positioning system occurs when the parking brake is in a released position.

17. The method of claim 16, further including disabling the implement positioning system in response to one of a movement of the parking brake to an engaged position and a movement of the implement lockout switch to an on position.

18. The method of claim 14, wherein the work implement is moved to the preset position when an input mechanism configured to control the movement of the work implement is in a centered position and a transmission is engaged.

19. The method of claim 14, wherein the preset position is established by disposing a switch on the work machine.

20. The method of claim 14, including:

receiving an indication of a monitored operating condition of the work machine, the monitored operating condition being indicative of a speed of the work machine; and moving the work implement to the preset position in response to the monitored operating condition of the work machine.

21. The method of claim 20, wherein receiving an indication of a monitored operating condition includes receiving at least one of a ground speed, a transmission speed, an engine speed, and a work machine acceleration.

22. A control system for a work implement on a work machine, comprising:

a sensor configured to provide an indication of a change in a travel direction of the work machine;

a sensor configured to provide an indication of a monitored operating condition of the work machine, the monitored operating condition being indicative of a speed of the work machine; and an input device configured to selectively enable an implement positioning system; and a controller having a memory configured to store a preset position for the work implement, the controller operable to move the work implement to the preset position in response to an enabling manipulation of the input device and the indication of the change in the travel direction of the work machine and in response to the monitored operating condition of the work machine.

23. The control system of claim 22, wherein the monitored operating condition is at least one of a ground speed, a transmission speed, an engine speed, and a work machine acceleration.

24. The control system of claim 22, wherein the controller is operable to move the work implement to the preset position at a speed based on the monitored operating condition of the work machine.

25. The control system of claim 22, wherein the controller is operable to move the work implement to the preset position when the monitored operating condition indicates that at least one of a ground speed is above a predetermined limit and a work machine acceleration is above a predetermined limit.

26. The control system of claim 22, wherein the memory of the controller is configured to store a preset elevated position of the work implement and a preset lowered position of the work implement.

27. The control system of claim 26, wherein the controller moves the work implement to the preset elevated position when the travel direction of the work machine is changed from a forward direction to a reverse direction and wherein the controller moves the work implement to the preset lowered position when the travel direction of the work machine is changed from the reverse direction to the forward direction.

28. A work machine, comprising:

a traction device;

an engine operable to generate a power output;

a transmission configured to transmit the power output of the engine to the traction device, the transmission further configured to drive the traction device in one of a forward direction and a reverse direction;

a work implement;

an input device configured to selectively enable an implement positioning system;

a sensor configured to provide an indication of a monitored operating condition of the work machine, the monitored operating condition being indicative of a speed of the work machine; and a controller having a memory configured to store a preset position for the work implement, the controller operable to move the work implement to the preset position in response to an enabling manipulation of the input device and an indication of a change in a travel direction of the traction device and in response to the monitored operating condition of the work machine.

29. The work machine of claim 28, wherein the sensor is configured to monitor at least one of a ground speed, a transmission speed, an engine speed, and a work machine acceleration.

30. The work machine of claim 28, wherein the memory of the controller is configured to store a preset elevated position of the work implement and a preset lowered position of the work implement.

31. The work machine of claim 30, wherein the controller moves the work implement to the preset elevated position when the travel direction of the traction device is changed from the forward direction to the reverse direction and wherein the controller moves the work implement to the preset lowered position when the direction of the traction device is changed from the reverse direction to the forward direction.

32. The work machine of claim 28, further including:

an implement positioning switch moveable between an enabling position and a disabling position;

a parking brake moveable between an engaged position and a disengaged position; and an implement lockout switch moveable between an on position and an off position.

33. The work machine of claim 28, wherein the memory is configured to store a first preset upper position, a first preset lower position, a second preset upper position, and a second preset lower position for the work implement, the controller being operable to move the work implement to one of the preset positions in response to an enabling manipulation of the input device and an indication of a change in a travel direction of the traction device and in response to the monitored operating condition of the work machine.

* * * * *